US007784674B2

(12) United States Patent
Grigsby

(10) Patent No.: US 7,784,674 B2
(45) Date of Patent: Aug. 31, 2010

(54) BULK MATERIALS CONTAINER

(75) Inventor: Charles F. Grigsby, Marietta, GA (US)

(73) Assignee: North American Container Corporation, Mableton, GA (US)

( * ) Notice: Subject to any disclaimer, the term of this patent is extended or adjusted under 35 U.S.C. 154(b) by 546 days.

(21) Appl. No.: 11/839,974

(22) Filed: Aug. 16, 2007

(65) Prior Publication Data

US 2009/0045248 A1 Feb. 19, 2009

(51) Int. Cl.
*B65D 5/32* (2006.01)
*B65D 5/42* (2006.01)

(52) U.S. Cl. ..... 229/122.32; 229/199; 229/939

(58) Field of Classification Search ..... 229/122.32, 229/199, 939; 206/386, 600
See application file for complete search history.

(56) References Cited

U.S. PATENT DOCUMENTS 2,109,789 A * 3/1938 Bangs ..... 229/939
2,330,294 A * 9/1943 Leavitt et al. ..... 229/122.32
2,710,134 A 6/1955 Schroeder et al.
3,199,763 A * 8/1965 Anderson ..... 229/939
3,385,504 A * 5/1968 Adams ..... 229/122.32
3,406,052 A 10/1968 Peters
3,864,200 A 2/1975 Marshall
4,586,627 A 5/1986 Grigsby
4,635,815 A * 1/1987 Grigsby ..... 229/122.33
4,746,061 A * 5/1988 Arvanigian ..... 229/939
4,905,864 A * 3/1990 Balin ..... 229/122.32
5,190,213 A * 3/1993 Horwitz ..... 229/939
5,323,922 A * 6/1994 Lapoint et al. ..... 229/199
5,938,111 A 8/1999 Grigsby
5,971,266 A 10/1999 Sampaolo et al.
6,126,067 A 10/2000 Grigsby, Jr. et al.
6,450,398 B1 * 9/2002 Muise et al. ..... 229/939
6,578,758 B1 6/2003 Grigsby, Jr. et al.
6,808,106 B1 10/2004 Grigsby et al.
7,229,003 B2 6/2007 Grigsby, Jr. et al

OTHER PUBLICATIONS

International Preliminary Examination Report (PCT/US08/54277), Aug. 4, 2009, 4 pages.

* cited by examiner

*Primary Examiner*—Gary E Elkins
(74) *Attorney, Agent, or Firm*—Baker Donelson Bearman Caldwell & Berkowitz

(57) ABSTRACT

A bulk materials container having a first wall-forming blank of corrugated paperboard sheets made of at least a flute member and a liner sheet, and scored to provide a series of main panels foldably joined together at opposing edges with each main panel having opposing top and bottom flaps foldably joined to respective edge portions and laminated to a second wall-forming blank having at least a flute member attached to a liner sheet scored to provide a series of main panels each having opposing top and bottom flaps foldably joined to respective edge portions, and a liner sheet and one of the first or second blanks extending beyond a distal edge of the respective top and bottom flaps, and folded over the distal edge and attached adhesively to the opposing surface so that the open channels of the flutes at the distal edge are covered.

18 Claims, 4 Drawing Sheets

BULK MATERIALS CONTAINER

TECHNICAL FIELD

The present invention relates to containers for holding and storing bulk materials. More particularly, the present invention relates to bulk material containers that seal edges from entry of particulate contaminants.

BACKGROUND OF THE INVENTION

Large-volume containers are often used for holding, storing, and transporting bulk materials, such as powders, agriculture leaf and root crop products, metal castings, plastic resins, and many other materials. Generally, the containers provide sturdy walls that protect the bulk materials from entry of pests and from container failure while allowing the containers to be handled by equipment such as fork lift trucks and platen or clamp trucks. The containers are also often stacked in warehouses.

One type of container useful for holding bulk materials assembles from corrugated paperboard blanks. A first blank defines the exterior walls and a second blank defines the interior walls. The laminated blanks fold on the scores and attach at opposing ends to define a tubular body having a cavity for holding the bulk materials. The exterior blank includes flaps that fold to form a bottom.

Bulk leaf products typically are filled through tubes that enter the container and withdraw as the container fills. A ram forces the leaf products into a block having high density and under compression within the container. The leaf products contain moisture, and the block starts expanding as the ram withdraws. Top flaps on the container fold to close the container. A plurality of straps generally spaced on approximately 6 inch intervals down the length of the container tighten and secure to prevent the top and bottom from opening to reveal the contents of the container. The filled containers are placed in stacks in warehouses for the leaf products to dry. After a period of time, the leaf product is removed for processing, and the container is typically re-used up to five times depending on the quality of the container after use.

The leaf products within the container however expand and press forcingly against the walls, bottom and top of the bulk materials container. Notwithstanding the straps, this expansion leads particularly to the top flaps buckling or bulging. The bulging tops have the potential for causing a stack of containers to tip, and a container that falls or a stack that tips over can cause injury to persons as well as loss of the product if the container bursts open because of the fall.

In addition, the corrugated inner liner has an open edge of exposed corrugated channels. As the leaf product fills the container, some dust, particulates, portions of leaves and stems may enter the channels. This is not satisfactory due to the re-use of the containers.

Accordingly, there is a need in the art for a bulk materials container that provides improved bulge resistance for stacking and restricts lodging and infiltration of particulates into the walls of the container. It is to such that the present invention is directed.

BRIEF SUMMARY OF THE INVENTION

The present invention solves the above-described problem in the prior art by providing a reinforced bulk materials container, comprising a first wall-forming blank of corrugated paperboard having at least a flute member sandwiched between opposing liner sheets to define a plurality of channels in the blank. The blank is scored to provide a series of main panels foldably joined together. Each main panel has a bottom flap foldably joined to an edge portion thereof and a top flap foldably joined to an opposing edge portion. The bottom flap and the top flap of each main panel have a distal edge that defines openings into the channels. The container includes a second wall-forming blank of corrugated paperboard having at least a flute member attached to a liner sheet to define a plurality of channels in the second blank, the second wall-forming blank of corrugated paperboard scored to provide a series of main panels foldably joined together. Each main panel has a bottom flap foldably joined to an edge portion thereof and a top flap foldably joined to an opposing edge portion. The second wall forming blank laminates to the first wall-forming blank. One of a plurality of tabs foldingly overlies the distal edge of a respective one of the joined top flaps and bottom flaps of the first and second wall-forming blanks and attaches to respective outward opposing surfaces thereof. This seals the edges of the laminated top and bottom flaps by the respective tab member restricting infiltration of particulates therein.

Objects, advantages and features of the present invention will become apparent from a reading of the following detailed description of the invention and claims in view of the appended drawings.

DETAILED DESCRIPTION

Figure 1:
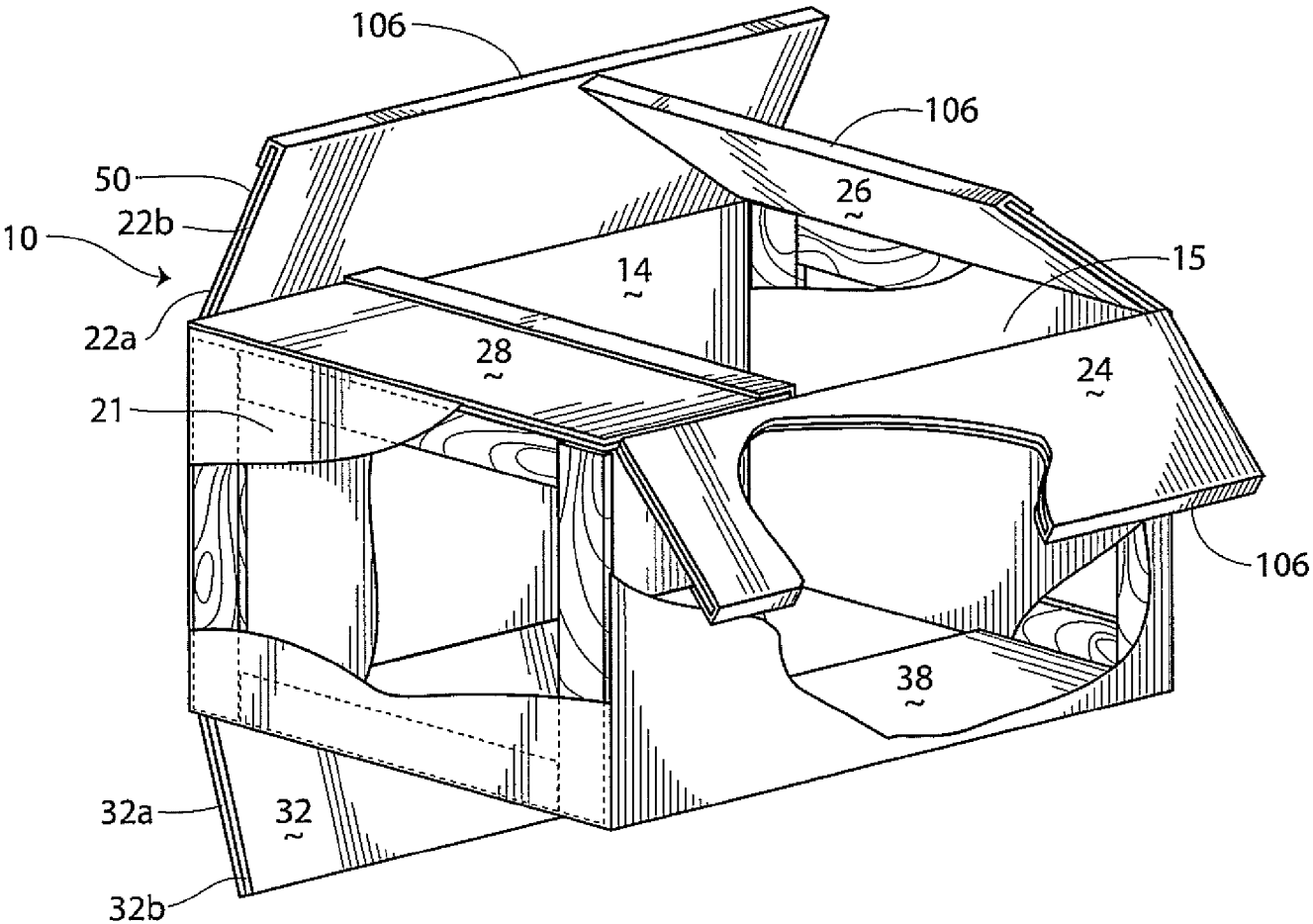
FIG. 1 illustrates in perspective view a bulk materials container according to the present invention, with portions cut away to illustrate features of the container.

Referring now in more detail to the drawings, in which like numerals indicate like parts throughout the several views, FIG. 1 illustrates in cut-away perspective a container 10 of the present invention for holding bulk materials. The container 10 is a tubular body that defines an outer wall generally 12 and inner wall generally 14 with an interior cavity 15 for holding bulk materials or other goods. The outer wall 12 and the inner wall 14 are each made from blanks of sheet material such as corrugated paperboard made conventionally with at least a flute sheet 16 and linerboard 18 (see FIG. 4) also known as paperboard or fiberboard. Without limitation, the blanks may be single wall, double wall, or variations, of conventional corrugated paperboard.

With continuing reference to FIG. 1, the container 10 includes top flaps 22, 24, 26, and 28 that foldingly close an upper end of the container. Opposing bottom flaps 32, 34, 36 and 38 foldingly close a bottom end of the container. A distal edge 40 of the respective top flaps and bottom flaps are closed by a tab 42. The tab 42 is defined by a laterally extending portion of the liner sheet 18 of the inner wall 14, although in an alternate embodiment, the tab extends from the outer wall 12. The portion of the liner sheet extends laterally of a terminating distal edge of the flute sheet. The tab overlaps the distal edge and attaches to an opposing surface of the respective flap. The tab 42 closes or seals the open channels at the edge of the corrugated flute sheet 16 from infiltration of particulates into the channels.

In an alternate embodiment, the tab 42 is separate band of a suitable material that overlies and closes the distal edge 40.

Figure 2:
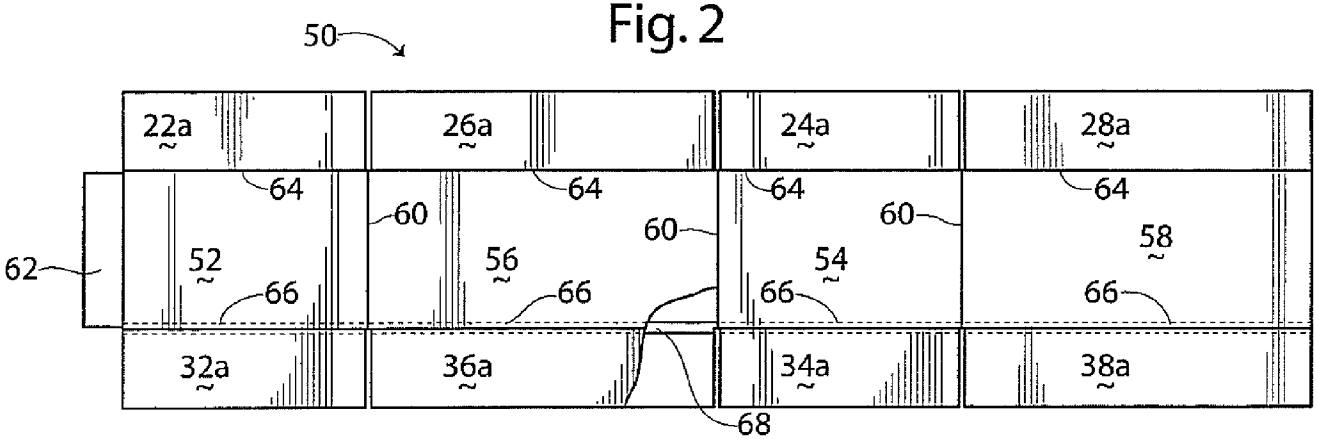
FIG. 2 illustrates in a plan view a corrugated paperboard blank for forming outer walls of the container shown in FIG. 1.

FIG. 2 illustrates in plan view a corrugated paperboard blank 50 for forming the outer or exterior wall 12 of the container 10. The blank 50 includes at least the flute member 16 and the liner sheet 18, but typically sandwiches the flute member with opposing liner sheets. Double wall or triple wall corrugated paperboard can be used as well. The illustrated embodiment uses BC flute corrugated paperboard. The blank 50 includes two opposing end panels 52, 54 and two opposing side panels 56, 58 foldably connected along respective scores 60. The end panels 52, 54 and the side panels 56, 58 define the exterior sides of the container 10 shown in FIG. 1. A manufacturer's joint flap 62 foldably connects on a score to the end panel 52. The manufacturer's joint flap 62 attaches with adhesive to a side portion of the side panel 58 to form a tubular body for the container 10. The scores 60 permit the container 10 to substantially flatten to a knock-down position for shipping from a container manufacturer to a company using the container. For use, the container 10 is squared-open as in FIG. 1 to define the cavity 15 for holding bulk materials.

FIG. 2 further illustrates the series of top flaps 22*a*, 24*a*, 26*a*, and 28*a* and opposing four bottom flaps 32*a*/34*a*, 36*a* and 38*a*. The respective top and bottom flaps foldably attach to the end and side panels 52, 54, 56, and 58, along respective scores 64, 66. The flaps, all extending the same length from their respective scores 64 and 66, can be of a single length that would be, at a minimum, of about slightly less than one half the width of the container, and at a maximum, approximately equal to the width of the container.

FIG. 2 also illustrates a wear member 68 (shown in cutaway view) disposed along the score lines 60 and overlaping portions of the main panels 52, 54, 56, and 58 and the flaps 32, 34, 36, and 38. The wear member 68 resists wear caused by contact with rough surfaces as the container 10 is moved and handled in warehouses or in trailers. The wear member 68 is an elongate member, such as a polyethylene tape, a fiber-reinforced tape, a plate such as metal or plastic, and attached adhesively to the blank or received inwardly of the blank.

Figure 2A:
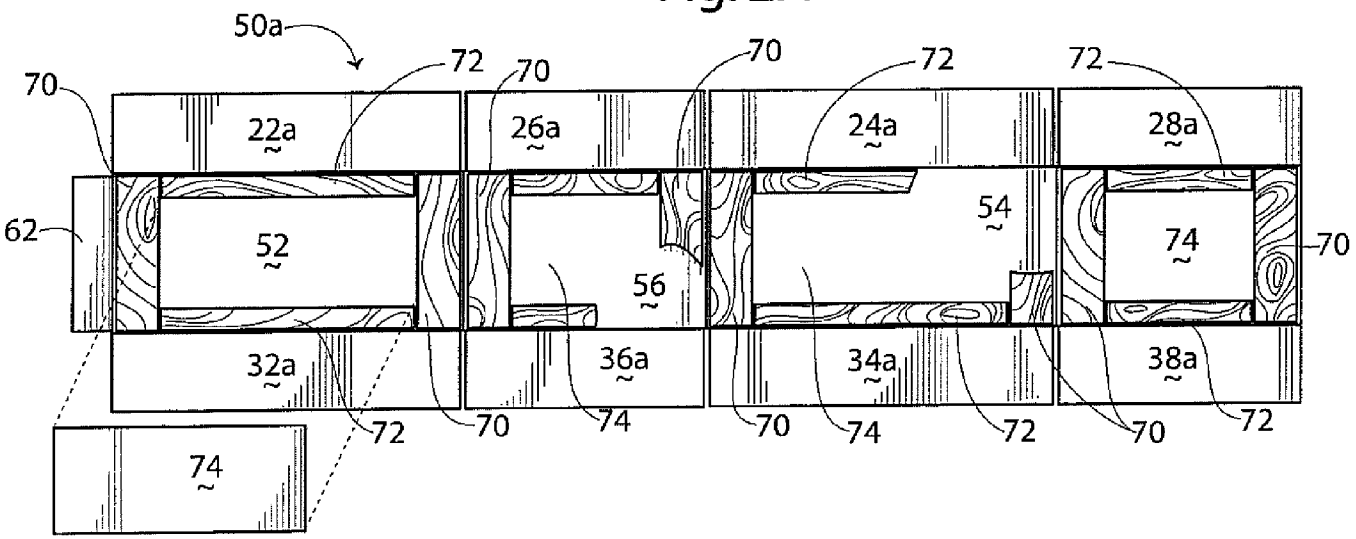
FIG. 2A illustrates in plan view a corrugated paperboard blank having support members and insert.

FIG. 2A illustrates an alternate embodiment of a blank 50*a* of sheet-like material suitable for forming the inner wall 14, such as corrugated paperboard. In this embodiment, each main panel 52, 54, 56, and 58 include opposing vertical members 70 and opposing horizontal members 72 that cooperatively define a "picture-frame" about a perimeter of the panel. A filler panel 74 attaches to the respective panel within the space defined by the members 70, 72, of each main panel. The vertical and horizontal members 70, 72 attach with adhesive and can be formed of any suitably rigid material, such as a hardwood or similar structural member, typically ranging in thickness from ⅛ inch to ½ inch and in width from 1 and ½ inches to 3 and ¾ inches. The length of the members 70 depends upon the height of the container 10. Preferably, the length is substantially equal to the height of the inner wall 14, which is, in turn, substantially equal to the interior or inside height of the container 10.

The vertical members 70 provide support when the container 10 is squared-open and erected for use and top load compression strength when the container 10 is loaded and stacked. The members 70 are disposed close to the corners defined by the scores 60, but not so close as to prevent the container from being folded down into a substantially flat position. Additionally, to further increase container rigidity and compression strength, a support member may be bonded intermediate the outer ends of the main panels 52, 54, 56 and 58 (not illustrated).

The filler pads 74 are formed of any suitably rigid sheet material, such as corrugated paperboard, a wood veneer. The filler pads 74 attach to the blank 60*a* with adhesive or other suitable bonding material. The thickness of the filler pads 74 is preferably equal to that of the members 70 and 72. The filler pads 98 fill the space defined by the perimeter of the members 94, 96, to provide a substantially planar face for the inner wall 14 which adheres to the blank defining the outer wall 12.

In an alternate embodiment, the members 70, 72 and the filler pads 74 are covered by a blank of corrugated paperboard sheet or a sheet of liner board.

Figure 3:
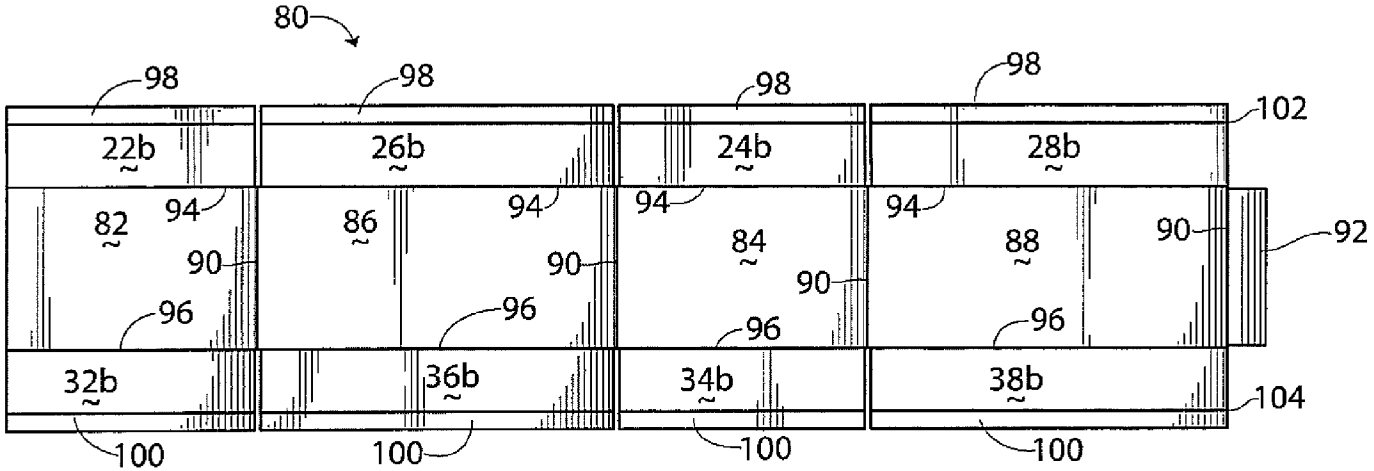
FIG. 3 illustrates in plan view a corrugated paperboard blank for forming interior walls of the container shown in FIG. 1.
Figure 5:
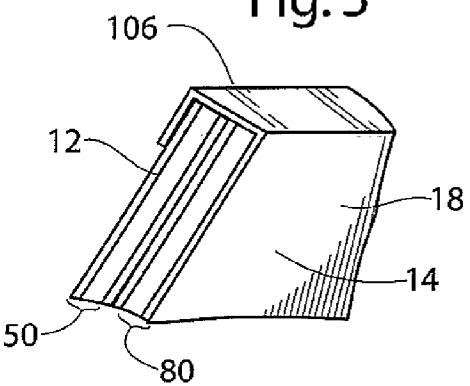
FIG. 5 is detailed perspective view of the distal portion of the laminated top flap with the tab overlapping the distal edge and attaching to an opposing surface of the top flap.

FIG. 3 illustrates in plan view a corrugated paperboard blank 80 for forming the inner wall 14 of the container 10. In the illustrated embodiment, the blank 80 includes the flute member 16 and the liner sheet 18, as illustrated in FIG. 5 discussed below. As with the blank 500, the blank 80 can be single, double or triple wall corrugated paperboard. The illustrated embodiment uses C flute corrugated paperboard. The blank 80 includes two opposing end panels 82, 84 and two opposing side panels 86, 88 foldably connected along standard corrugator scores 90.

The end panels 82, 84 and the side panels 86, 88 define the interior sides of the container 10 shown in FIG. 1. A manufacturer's joint flap 92 foldably connects on a score 78 to the side panel 64. The manufacturer's joint flap 92 attaches with adhesive to a side portion of the end panel 82 to form a tubular body for the container 10. The scores 90 cooperate with the scores 60 of the first blank 50 to permit the container 10 to substantially flatten to a knock-down position for shipping from a container manufacturer to a company using the container.

FIG. 3 further illustrates the series of top flaps 22*b*, 24*b*, 26*b*, and 28*b* and opposing four bottom flaps 32*b*, 34*b*, 36*b* and 38*b*. The respective top and bottom flaps foldably attach to the end and side panels 82, 84, 86, and 88, along respective scores 94, 96. The flaps, all extending the same length from their respective scores 94 and 96, can be of a single length that would be, at a minimum, of about slightly less than one half the width of the container, and at a maximum, approximately equal to the width of the container.

A portion 98, 100 of the liner 18 that forms the blank 80 extends outwardly from respective distal edges 102, 104 of the top flaps and the bottom flaps, respectively. The portion 98, 100 on the respective flaps defines the tab 106 for purposes discussed below.

Figure 4:
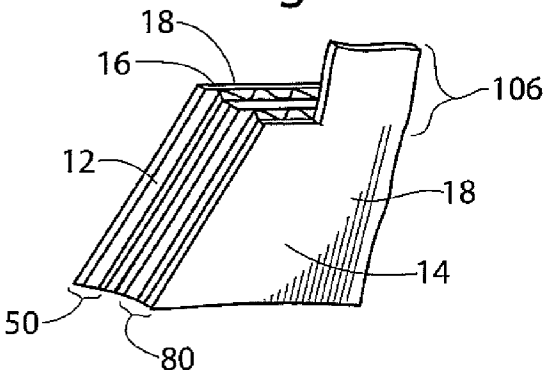
FIG. 4 is a detailed perspective view of a distal portion of the laminated top flaps with a tab extending laterally of the distal edge thereof.

FIG. 4 illustrates in detailed perspective view a distal portion of the top flap 22 formed by laminating the top flaps 22*a*, 22*b* together. The tab 106 extends laterally of the distal edge of the flange 22. The other top flaps 24, 26, and 28 and the opposing bottom flaps 32, 34, 36, and 38 are similarly formed by laminating the respective flaps of the outer wall-forming board 12 and the inner wall forming board 14.

FIG. 5 illustrates in detailed perspective view the distal portion of the laminated top flap 22 with the tab 106 overlapping the distal edge 102 and attaching adhesively to an opposing surface of the top flap defined by the top flap 22*a* of the outer wall-forming blank 50.

Figure 6:
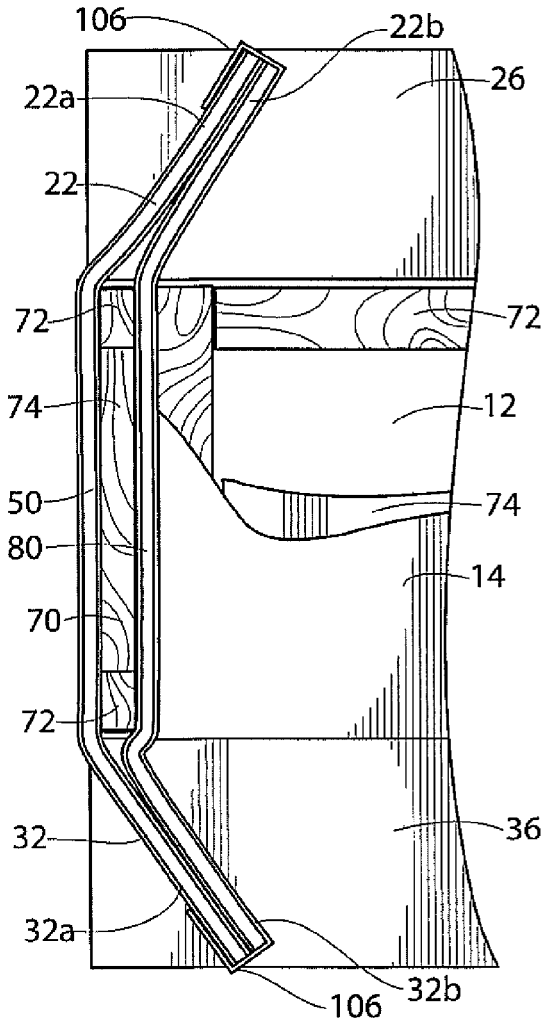
FIG. 6 illustrates in detailed cross-sectional side view the corrugated paperboard blanks laminated together for forming the walls of the container illustrated in FIG. 1.

FIG. 6 illustrates in detailed cross-sectional side view the corrugated paperboard blanks 50, 80 laminated together for forming the walls of the container 10 illustrated in FIG. 1. The opposing top flaps 22*a*, 22*b* laminate together to form the top flap 22. The tab 106 covers the distal end 102 that has the otherwise open corrugation channels of the flute sheet 16. Similarly, the other respective top flaps 24*a*, 24*b*; 26*a*, 26*b*; and 28*a*, 28*b* of the blanks 50, 80 laminate together to form the respective top flaps 24, 26, and 28. The respective tabs 106 overlie the distal ends and attach adhesively to the opposing surface to close the distal ends.

Similarly, the respective bottom flaps 32*a*, 32*b*; 34*a*, 34*b*; 36*a*, 36*b*; and 38*a*, 38*b* of the blanks 50, 80 laminate together to form the respective bottom flaps 32, 34, 36, and 38. The respective tabs 106 overlie the distal ends 104 and attach adhesively to the opposing surface to close the distal ends.

It is to be appreciated that the tabs 106 can extend from the liner 16 of the blank 50, and fold inwardly to attach to the surface of the flap on the blank 80.

Figure 7:
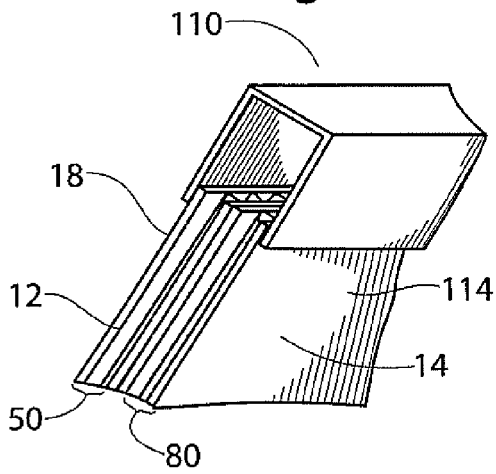
FIG. 7 illustrates in detailed perspective view an alternate embodiment using a strip member as the tab to cover the distal end of the flap of the container.

FIG. 7 illustrates in detailed perspective view an alternate embodiment that uses a separate strip member 110 as the tab to cover the distal end 102, 104 of the respective top and bottom flaps of the container. The strip members 110 attach with adhesive to the opposing surfaces 112, 114 of the blanks 50, 80 that laminate together to define the top and bottom flaps 22, 24, 26, 28 and 32, 34, 36, and 38 of the container 10.

While FIG. 1 does not illustrate a bottom support member such as a pallet or a slip sheet, various bottom support members could be provided including, but not limited to, pallets, slip sheets and bottom caps. Such bottom support members are well known in the art, and are not disclosed further herein.

Prior to use, the knocked-down container 10 is squared-open to define the cavity 15 for receiving bulk materials. The bottom flaps 32, 34, 36, and 38 are folded towards the respective opposing flap on the respective scores to close the open lower end of the container 10. Upon filling, the top flaps 22, 24, 26, and 28 fold towards the respective opposing flap on the respective scores to close the open upper end of the container 10. The straps wrap around the container to hold the flaps closed. The tabs 106 cover the open channels of the corrugations at the distal edges of the top and bottom flaps to restrict infiltration of particulates into the side walls of the container through the open flutes.

The laminated top flaps 22, 24, 26, and 26 provide improved top loading and compression strength to the bulk materials container to resist bulging and buckling arising from the compressed moist leaf products held in the container for drying. The present invention provides an improved bulk materials container suitable for holding agriculture and leaf products, granular materials, bulk particulate materials, or other bulk items requiring long-term storage while restricting lodging and infiltration of particulates in the channels of the corrugated paperboard sheets that form the inner wall and the outer wall. The present invention furthermore provides a one-piece, integral unit that can be knocked down flat for shipment to an end user and easily and quickly set up by an end user.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A reinforced bulk materials container, comprising:

a first wall-forming blank of corrugated paperboard having at least a flute member sandwiched between opposing liner sheets to define a plurality of channels in the first blank, the blank scored to provide a series of main panels foldably joined together, each main panel having a bottom flap foldably joined to an edge portion thereof and a top flap foldably joined to an opposing edge portion, the bottom flap and the top flap of each main panel having a distal edge that defines openings into the channels; and a second wall-forming blank of corrugated paperboard having at least a flute member attached to a liner sheet to define a plurality of channels in the second blank, the second wall-forming blank of corrugated paperboard scored to provide a series of main panels foldably joined together, each main panel having a bottom flap foldably joined to an edge portion thereof and a top flap foldably joined to an opposing edge portion, the second wall forming blank laminated to the first wall-forming blank;

a plurality of tab members, each directly attached to at least one opposing surface in overlying relation to a distal edge portion of a respective one of the joined top flaps and bottom flaps of the first and second wall-forming blanks, whereby the channels within the laminated top and bottom flaps are sealed by the respective tab member to restrict infiltration of particulates through the open ends of the opposing distal edges thereof.

2. The reinforced bulk materials container as recited in claim 1, wherein the tab member is defined by one of the liner sheets of the first or second wall-forming blank extending laterally of a terminating distal edge of the flute member in the respective top flap and bottom flap, said tab member foldingly overlies the distal edge of the respective one of the joined top flaps and bottom flaps of the first and second wall-forming blanks and attaches to respective outward opposing surface thereof.

3. The reinforced bulk materials container as recited in claim 1, further comprising:

a plurality of support members fixedly attached about a perimeter of each main panel on the second wall-forming blank;

a filler pad bonded to each main panel of the second wall-forming blank within the perimeter defined by the support members;

the second wall-forming blank laminated to the interior surface of the first wall-forming blank to dispose the supports and the filler pad between the interior surface of the first wall-forming blank and the flute member of the second wall-forming blank.

4. The reinforced bulk material container as recited in claim 3, wherein the filler pad comprises corrugated paperboard.

5. The reinforced bulk material container as recited in claim 1, further comprising a wear reducing member attached along the foldable connection of the bottom flaps and the main panels of the first blank and overlapping lateral portions thereof, whereby the wear reducing member resists the bottom edges of the container from wearing through by movement of the container on rough surfaces.

6. The reinforced bulk material container as recited in claim 3, wherein the filler pads are fibreboard.

7. The reinforced bulk materials container as recited in claim 1, wherein the tab members comprise a plurality of elongated strips, at least one of the elongated strips attached to opposing surfaces of a respective one of the joined top flaps or joined bottom flaps in overlying relation to the distal edge thereof 8. The reinforced bulk materials container as recited in claim 1, wherein the tab members attach adhesively.

9. The reinforced bulk materials container as recited in claim 1, wherein the tab member is defined by an elongated strip that adhesively attaches directly to opposing surfaces of the respective joined top flaps or bottom flaps of the first and second wall fowling blanks.

10. The reinforced bulk materials container as recited in claim 1, wherein the flute members in the respective first and second wall-forming blanks are co-extensive in size whereby the distal edges of the top flaps thereof terminate co-extensively and the distal edges of the bottom flaps thereof terminate co-extensively.

11. A reinforced bulk materials container, comprising:

a first wall-forming blank of corrugated paperboard having at least a flute member sandwiched between opposing liner sheets to define a plurality of channels in the blank, the blank scored to provide a series of main panels foldably joined together, each main panel having a bottom flap foldably joined to an edge portion thereof and a top flap foldably joined to an opposing edge portion, the bottom flap and the top flap of each main panel having a distal edge that defines openings into the channels;

a second wall-forming blank of corrugated paperboard having at least a flute member attached to a liner sheet to define a plurality of channels in the second blank and the second bland scored to provide a series of main panels foldably joined together, each main panel having a bottom flap foldably joined to an edge portion thereof and a top flap foldably joined to an opposing edge portion;

a plurality of support members fixedly attached about a perimeter of each main panel on the first wall-forming blank;

a filler pad bonded to each main panel of the first wall-forming blank within the perimeter defined by the support members;

the second wall-forming blank laminated to the first wall-forming blank to dispose the supports and the filler pad between the first wall-forming blank and the second wall-forming blank;

a plurality of tab members, each attached in overlying relation to at least one opposing surface in a distal edge portion of a respective one of the joined top flaps or bottom flaps of the first and second wall-forming blanks, whereby the channels within the laminated top and bottom flaps are sealed by the respective tab member to restrict infiltration of particulates through the open ends of the opposing distal edges thereof.

12. The reinforced bulk materials container as recited in claim 11, wherein a liner sheet in one of the first or second wall-forming blanks defines the tab members with a first portion of the liner sheet extending laterally of a terminating distal edge of the flute member of the respective top flap and a second portion thereof extending laterally of a terminating distal edge of the flute member in the respective bottom flap, said first portion foldingly overlies the distal edge of the joined top flaps and attaches to an opposing surface thereof, and said second portion foldingly overlies the distal edge of the joined bottom flaps and attaches to an opposing surface thereof, whereby the edge of the top flaps and the bottom flaps are sealed by first and second portions.

13. The reinforced bulk materials container as recited in claim 11, wherein the tab members comprise a plurality of elongated strips.

14. The reinforced bulk materials container as recited in claim 13, wherein the tab members attach adhesively to the respective opposing surfaces.

15. A reinforced bulk materials container, comprising:

a pair of wall-forming blanks having at least a flute member attached to a liner sheet to define a plurality of channels in the respective blank, each scored to provide a series of main panels foldably joined together and each main panel having a bottom flap foldably joined to an edge portion thereof and a top flap foldably joined to an opposing edge portion;

a plurality of support members fixedly attached about a perimeter of each main panel on one of the wall-forming blanks;

a filler pad bonded to each main panel of the first wall-forming blank within the perimeter defined by the support members;

the second wall-forming blank laminated to the first wall-forming blank to dispose the supports and the filler pad between the first and second wall-forming blanks; and a plurality of tab members, each attached in overlying relation to a distal edge portion of a respective one of the joined top flaps or bottom flaps of the laminated first and second wall-forming blanks whereby the channels within the joined top and bottom flaps are sealed by the respective tab member to restrict infiltration of particulates through the open ends of the opposing distal edges thereof.

16. The reinforced bulk materials container as recited in claim 15, wherein one of the liner sheets defines the tab members with a first portion of the liner sheet extending laterally of a terminating distal edge of the flute member in the respective top flap and a second portion thereof extending laterally of a terminating distal edge of the flute member in the respective bottom flap, said first portion foldingly overlies the distal edge of the joined top flaps and attaches to an opposing surface thereof, and said second portion foldingly overlies the distal edge of the joined bottom flaps and attaches to an opposing surface thereof, whereby the edges of the flute member open at the distal edge of the top flaps and the bottom flaps are sealed by the first and second portions to restrict infiltration of particulates therein.

17. The reinforced bulk materials container as recited in claim 15, wherein the tab members comprise a plurality of elongated strips.

18. The reinforced bulk materials container as recited in claim 17, wherein the tab members attach adhesively to the respective opposing surfaces.

* * * * *